US005535894A

United States Patent [19]

Ishiwata

[11] Patent Number: 5,535,894

[45] Date of Patent: Jul. 16, 1996

[54] APPARATUS FOR CONVEYING, ACCOMMODATING AND PAYING OUT BANK NOTES

[76] Inventor: Yoshikazu Ishiwata, 1-14-9 Tamatsutsumi, Setagaya-ku, Tokyo, Japan

[21] Appl. No.: 443,443

[22] Filed: May 18, 1995

Related U.S. Application Data

[62] Division of Ser. No. 156,781, Nov. 23, 1993.

[30] Foreign Application Priority Data

Nov. 26, 1992 [JP] Japan ..... 4-087230

[51] Int. Cl.[6] ..... B07C 5/00

[52] U.S. Cl. ..... 209/534; 271/3.03; 271/3.05; 271/35; 271/121; 271/303; 271/207; 271/178

[58] Field of Search ..... 209/534; 271/3.03, 271/3.05, 3.06, 288, 303, 304, 35, 121, 125, 207, 177, 178, 179

[56] References Cited

U.S. PATENT DOCUMENTS

| | | | |
|---|---|---|---|
| 3,266,798 | 8/1966 | Bleiman | 271/305 |
| 3,365,193 | 1/1968 | Davis | 271/178 |
| 3,831,928 | 8/1974 | Davis | 271/35 |
| 3,907,278 | 9/1975 | Jaton | 271/35 |
| 4,441,702 | 4/1984 | Nagel et al. | 271/177 |
| 4,494,747 | 1/1985 | Graef et al. | 221/21 |
| 4,759,448 | 7/1988 | Kawabata | 209/534 |
| 5,064,074 | 11/1991 | Edin et al. | 271/35 |
| 5,116,036 | 5/1992 | LeRoy et al. | 271/3.03 |
| 5,135,212 | 8/1992 | Utsumi et al. | 271/3.03 |

FOREIGN PATENT DOCUMENTS

| | | | |
|---|---|---|---|
| 0219630 | 4/1987 | European Pat. Off. | 271/35 |
| 0295945 | 12/1986 | Japan | 271/109 |
| 0211231 | 9/1987 | Japan | 271/119 |
| 03111370 | 5/1991 | Japan | 271/272 |
| 03288762 | 12/1991 | Japan | 271/177 |

*Primary Examiner*—H. Grant Skaggs
*Attorney, Agent, or Firm*—Frishauf, Holtz, Goodman, Langer & Chick

[57] ABSTRACT

Apparatus for conveying, accommodating and paying out bank notes, includes shaft-mounted guide rollers for feeding bank notes from a stacking space to a pay-out tray, shaft-mounted vane wheels with eccentric ends mounted between adjacent guide rollers, a spring-biased shutter at an inlet/outlet of the pay-out tray, a lid covering a stacking space and including a finger application notch, the lid being opened and closed by one touch operation when a spring is brought to a dead point, a conveying path communicating with a bank note insertion opening and including a pair of bank note guide bars having a substantially S-shaped sectional profile, large and small monetary amount stacking spaces provided above and below the guide bars, respectively, such that bank notes are fed to either stacking space with forward or reverse rotation of the guide bars, a stationary roller provided with an adjacent ratchet wheel, and step rotated by an operating member with an end pawl thereof engaged with a ratchet wheel tooth to dispense bank notes, a friction pinch roller spring biased for moving bank notes along the conveying path, a sensor group for checking the genuineness of bank notes and determining the kind thereof, the sensor group being mountable and dismountable as an integral unit in and out of the apparatus, and bank note guide bars having a substantially S-shaped sectional profile disposed at right angles to one another for stacking bank notes in a curved state.

13 Claims, 17 Drawing Sheets

FIG. 24
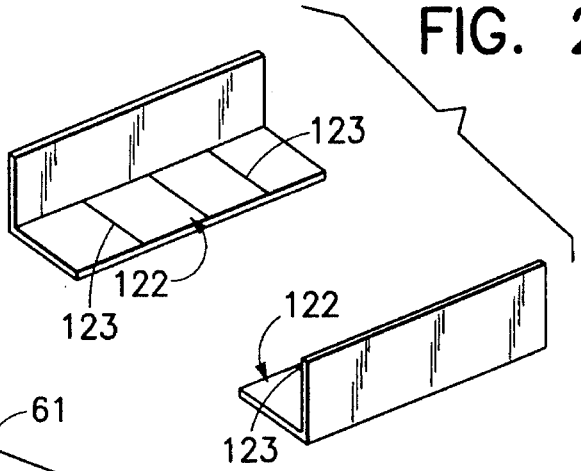
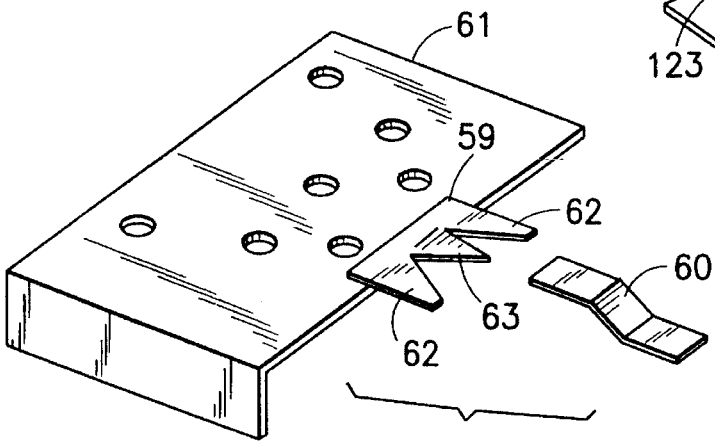
FIG. 25
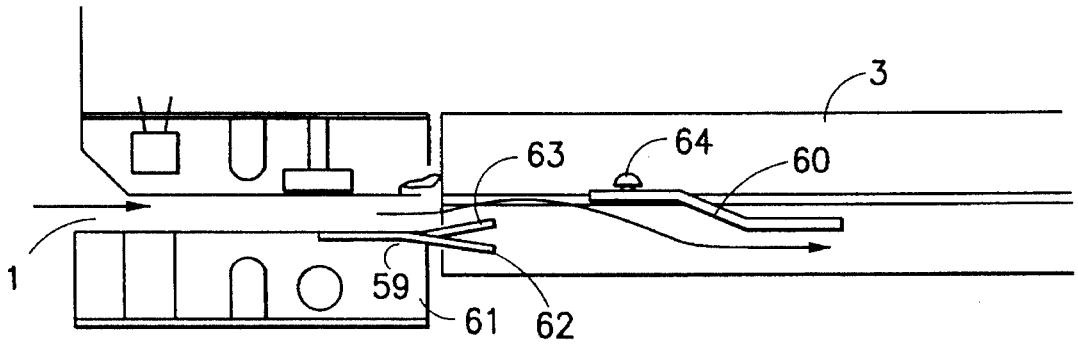
FIG. 26
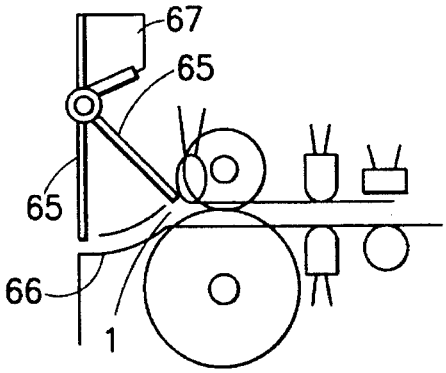
FIG. 27

FIG. 28
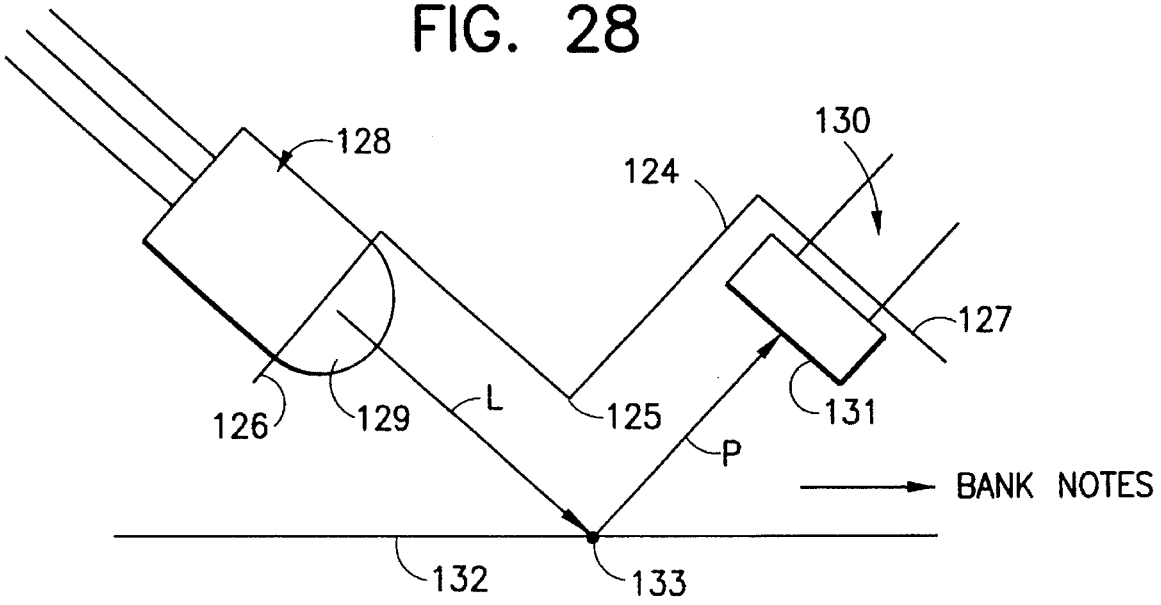
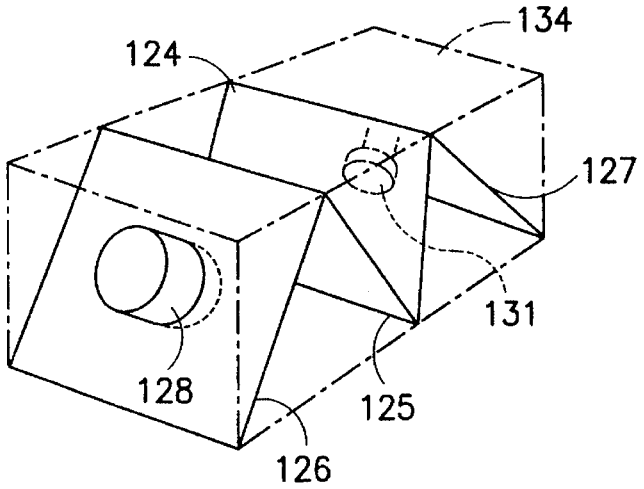
FIG. 29
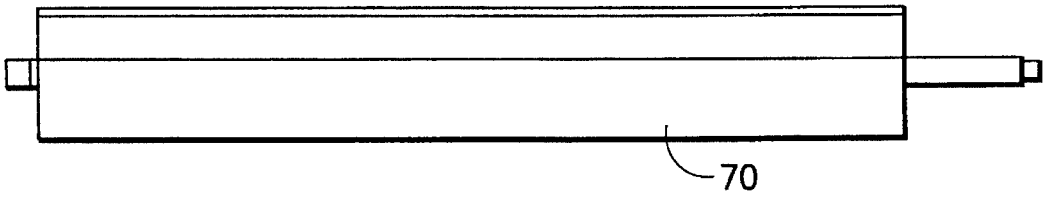
FIG. 30

APPARATUS FOR CONVEYING, ACCOMMODATING AND PAYING OUT BANK NOTES

This is a division of application Ser. No. 08/156,781 filed Nov. 23, 1993 pended.

BACKGROUND OF THE INVENTION

The present invention relates to an apparatus for conveying, accommodating and paying out bank notes and, more particularly, is directed to an apparatus for conveying, accommodating and paying out bank notes used for automatic selling machines, automatic releasing machines, money exchanges and the like, which can deal with a plurality of different kinds of bank notes and which can recycle some of these types of bank notes as change or exchange money. Specifically, the invention is directed to improvements in small size apparatus of this type, which have a width equal to or less than 100 mm, a depth equal to or less than 250 mm and a height equal to or less than 350, so that the apparatus can be installed in game places or the like.

Recently, there have been provided automatic machines which can be used with bank notes and coins, and also with bank notes of a large monetary value. Most of these machines, however, have a complicated structure and are relatively large. Therefore, a large installation space is required, thereby limiting their use. Also, trouble and erroneous operations, such as jamming or overlap feeding of bank notes, has been increasing with such apparatus.

The present invention was created in view of these technical problems which are inherent in the prior art.

Thus, it is an object of the present invention to provide an apparatus for conveying, accommodating and paying out bank notes, which solves such problems.

It is another object of the present invention to provide an apparatus for conveying, accommodating and paying out bank notes, with an improved accuracy of operation.

It is still another object of the present invention to provide an apparatus for conveying, accommodating and paying out bank notes, that is reduced to a limit size so that it can be installed in a greater variety of areas, without substantial need of carefully selecting the place of installation.

It is yet another object of the present invention to provide an apparatus for conveying, accommodating and paying out bank notes, that is easy and inexpensive to make and use.

With the present invention, the performance and operation control property of the individual components can be improved to meet the end, the accuracy of the entire apparatus can be improved, the number of component parts can be improved to reduce the size of the entire apparatus, and the price thereof can be reduced.

SUMMARY OF THE INVENTION

In accordance with an aspect of the present invention, an apparatus for conveying, accommodating and paying out bank notes, includes a shaft; a plurality of guide roller means, mounted on the shaft, for guiding bank notes being fed from a stacking space to a pay-out tray, and a plurality of vane wheel means, provided on the shaft between adjacent ones of the guide rollers, respectively, for arranging the bank notes as the bank notes are fed under the guide roller means, the vane wheel means having eccentric ends.

Further, a spring-biased shutter is disposed at an entrance/exit of the pay-out tray. Also, a lid member is provided in a portion of the stacking space and has a finger application notch for opening the lid member to provide access to the stacking space.

Spring-biased roller friction pinch roller means is also provided for feeding the bank notes with a friction contact therewith.

In accordance with another aspect of the present invention, an apparatus for conveying, accommodating and paying out bank notes, includes large monetary amount bank note stacking space means for holding large monetary amount bank notes, recycled bank note stacking space means for holding recycled bank notes used as change, and a pair of rotatable bank note guide bars disposed in a conveying path and communicating with a bank note insertion opening, the bank note guide bars being positioned below the large monetary amount bank note stacking space means and above the recycled bank note stacking space means such that bank notes are selectively fed by the guide bars to either of the bank note stacking space means upon forward or reverse rotation of the guide bars, respectively.

In addition, urging means is provided for urging large monetary amount bank notes in the large monetary amount bank note stacking space means above the guide bars.

The guide bars are mounted on shafts, and bank note winding prevention means is provided extending from a casing to the shafts of the guide bars.

Also, there is a sensor means, including an integral group of sensors, for checking genuineness of bank notes and determining a kind thereof, the sensor means being mountable and dismountable from the apparatus.

Preferably, each bank note guide bar has an S-shaped sectional profile. Also, the guide bars have grooves therein, and further including aligning means for adjusting for a small length bank note to re-engage the small length bank note in the grooves of the guide bars so as to increase the accuracy of falling of the small length bank note into the recycled bank note stacking space means.

There is also provided assisting means, disposed at a position intermediate between the rotatable bank note guide bars for pushing up a bank note, thereby assisting in formation of a V-shaped folded state of the bank note.

In accordance with still another aspect of the present invention, an apparatus for conveying, accommodating and paying out bank notes, includes a shaft, stationary roller means, supported on the shaft, for preventing bank notes from being fed in an overlapped state to a pay-out tray, a ratchet wheel mounted on the shaft and have teeth therearound, the ratchet wheel being in contact with the stationary roller means such that rotation of the ratchet wheel results in rotation of the stationary roller means, and pawl member means, having an end thereof engaged with one tooth of the ratchet wheel, for driving the ratchet wheel in a step-like manner, and thereby resulting in rotation of the stationary roller in the step-like manner.

In accordance with yet another aspect of the present invention, an apparatus for conveying, accommodating and paying out bank notes, includes a pivotable lid member, a wire connected between the lid member and a frame portion, and a spring connected intermediate of the wire, wherein the lid member is opened and closed by one-touch operation when a dead point of the spring is passed.

There is also provided large monetary amount bank note stacking space means for holding large monetary amount bank notes, and means for slidably guiding the large monetary amount bank note stacking space means to open and close the same in a longitudinal direction by means of the wire and the spring upon opening and closing of the lid member.

In accordance with a further aspect of the present invention, an apparatus for conveying, accommodating and paying out bank notes, includes first rotatable bank note guide bars having an S-shaped sectional profile, and second rotatable bank note guide bars having an S-shaped sectional profile and extending perpendicular to the first bank note guide bars, such that the first and second bank notes are transported by the first and second rotatable bank note guide bars from an insertion opening and stacked in a curved form against the first and second rotatable bank note guide bars upon rotation thereof.

In accordance with a still further aspect of the present invention, an apparatus for conveying, accommodating and paying out bank notes, includes a pair of first rotary guide bars extending from a bank note insertion opening and each having an S-shaped sectional profile for guiding opposite edges of the bank notes, a recycled bank note stacking space/hopper means, provided below the first rotary guide bars, for holding recycled bank notes, large monetary amount bark note conveying path means, having one end extending from an end of the first rotary guide bars opposite the insertion opening, for conveying large monetary amount bank notes from the first rotary guide bars, a pair of second rotary guide bars extending from an opposite end of the large monetary amount bank note conveying path means so as to receive large monetary amount bank notes from the large monetary amount bank note conveying path means, and large monetary amount bank note stacking space means provided above and below the second rotary guide bars.

The second rotary guide bars also have an S-shaped sectional profile and each of the first and second rotary guide bars has a groove, and further comprising bank note winding prevention spring means disposed near each of the first and second rotary guide bars and having a length such that an end thereof slightly extends in a groove in a respective rotary guide bar in a stand-by state thereof in which a bank note is inserted.

The spring means is made of a plastic material and is provided with node means for distributing a resistance force thereacross.

In addition, friction roller means and a plurality of belt means are provided for conveying recycled bank notes from the stacking space/hopper means to a pay-out tray.

Also, overlap feed prevention stationary roller means is provided in contact with the friction roller means for feeding bank notes from the recycled bank note stacking space/hopper means to the pay-out tray, the overlap feed prevention stationary roller means being rotatable in one direction only and having a hardness ranging from 40 to 60.

The stacking space/hopper means includes swing arm means for assisting in conveying of bank notes by applying pressure to the bank notes and removing wrinkles and folding traces of the bank notes. Also, a pay-out tray is provided having a non-repulsive rubber member provided on a side in contact with a recycled bank note.

In accordance with a yet further aspect of the present invention, an apparatus for conveying, accommodating and paying out bank notes, includes a pay-out tray pivotable about one side thereof, pocket means for accommodating miscounted bank notes, and confirmation sensor means for detecting a miscounted bank note such that the pay-out tray is restored when a miscounted bank note is detected by the confirmation sensor means so that the pay-out tray resumes counting of bank notes.

In accordance with another aspect of the present invention, an apparatus for conveying, accommodating and paying out bank notes, includes a bank note insertion opening for retrieving bank notes, and crime prevention means, provided at the bank note insertion opening, for preventing unauthorized access to the bank note insertion opening, the crime prevention means including swing door means for opening and closing the bank insertion opening, the swing door means being pivotally mounted in front of the opening, means for opening and closing the swing door, and photo-interrupter means for permitting opening of the swing door means.

In accordance with still another aspect of the present invention, an apparatus for conveying, accommodating and paying out bank notes, includes sensor means for checking the genuineness and kind of bank notes, the sensor means including a thin base bent substantially at right angles at least at three positions, ultraviolet light emitting means, provided with a light-emitting section inside one end portion of the thin base, for emitting light onto a bank note carried along a conveying path, and light-receiving means, provided with a light-receiving section inside another end portion of the thin base, for receiving light reflected from the bank note.

BRIEF DESCRIPTION OF THE DRAWINGS

FIG. 24 is a perspective view showing a winding prevention spring member of the apparatus;

FIG. 25 is a perspective view showing a withdrawal prevention mechanism of the apparatus;

FIG. 26 is a side view of the withdrawal prevention mechanism of FIG. 25 in a mounted state;

FIG. 27 is a side view of a different withdrawal prevention mechanism of the apparatus;

FIG. 28 is a side view showing an application of a photoelectric element according to the present invention to a system for checking the genuineness of bank notes;

FIG. 29 is a perspective view of the photoelectric element of FIG. 28; and FIG. 30 is a side view of the photoelectric element of FIG. 28.

DETAILED DESCRIPTION

Figure 1:
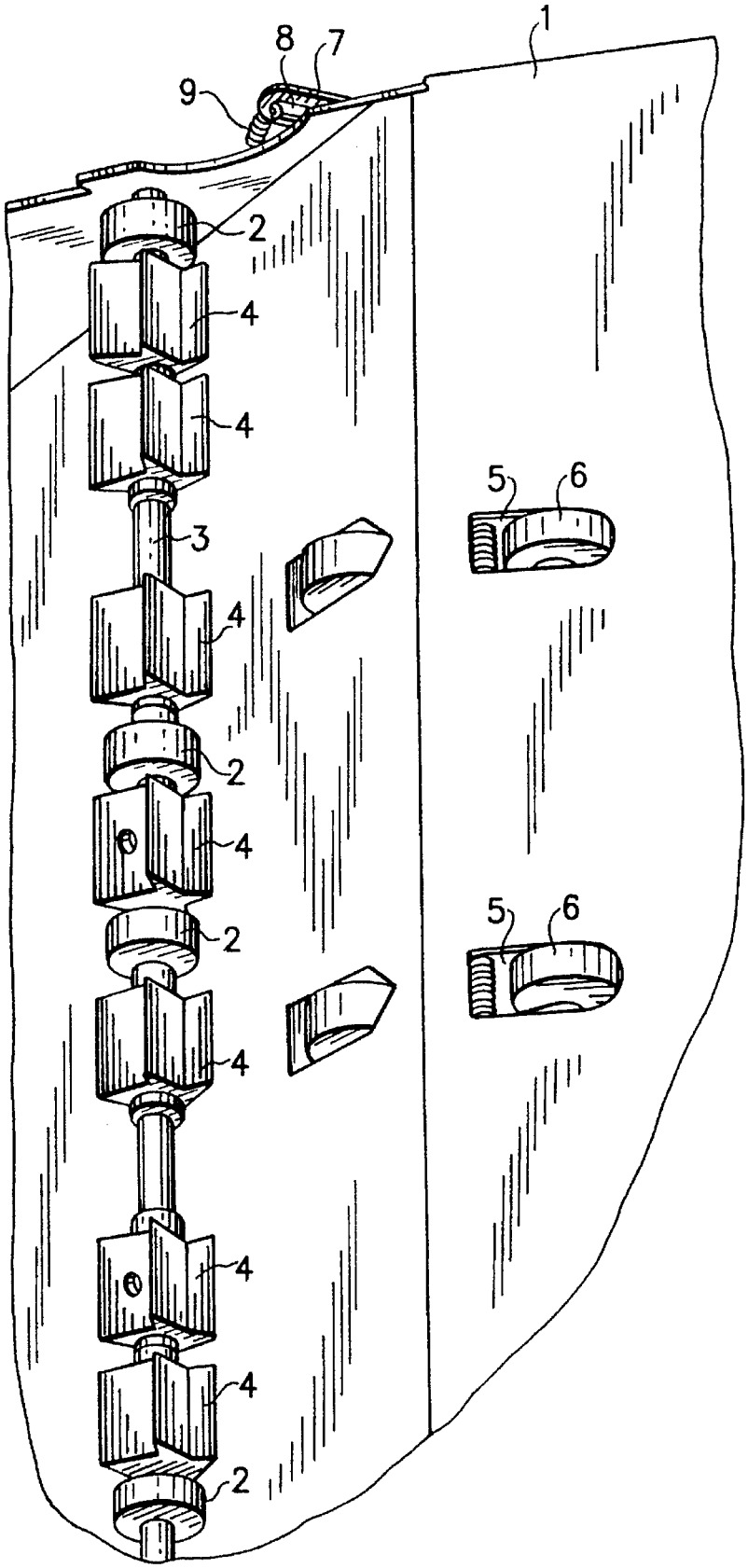
FIG. 1 is a fragmentary perspective view showing guide rollers and pinch rollers of an apparatus for conveying, accommodating and paying out bank notes according to the present invention.

Referring to the drawings in detail, and initially to

FIG. 1 thereof, a mechanism embodying the present invention includes a bottom 1 of a stacking space, into which bank notes having been inserted from a bank note insertion opening and judged to be genuine bank notes, are inserted. From this stacking space, bank notes are counted and fed out as change by a combination mechanism including a roller, a drum and the like. Guide rollers 2 are coaxially mounted on a shaft 3 for guiding bank notes being fed to a pay-out tray. Vane wheels 4 are also mounted on shaft 3, each vane wheel 4 having a plurality of eccentric vanes arranged at a pitch of 90 degrees and each vane having a tapered end. The vanes of the different vane wheels 4 are aligned with each other as to their relative direction and position. When bank notes are fed to the pay-out tray, vane wheels 4 dispose of and arrange the bank notes as the bank notes are fed under the guide of guide rollers 2, thus attaining more reliable prevention of jamming or overlap feed of the bank notes.

Stacking space bottom 1 has windows or openings 5, through which pinch rollers 6 project into rolling contact with a bank note being fed. Pinch rollers 6 are mounted coaxially on a shaft (not shown), and a bracket 7 is mounted on an end of the shaft. Bracket 7 has an engagement hole 8, with which an end of a coil spring 9 is engaged. Pinch rollers 6 are thus urged toward openings 5 by the biasing force of coil spring 9. In this regard, pinch rollers 6 can be advanced out from and retracted into openings 5 to provide a buffering action with respect to twisting, wrinkles or the like of the bank note being fed.

Figure 2:
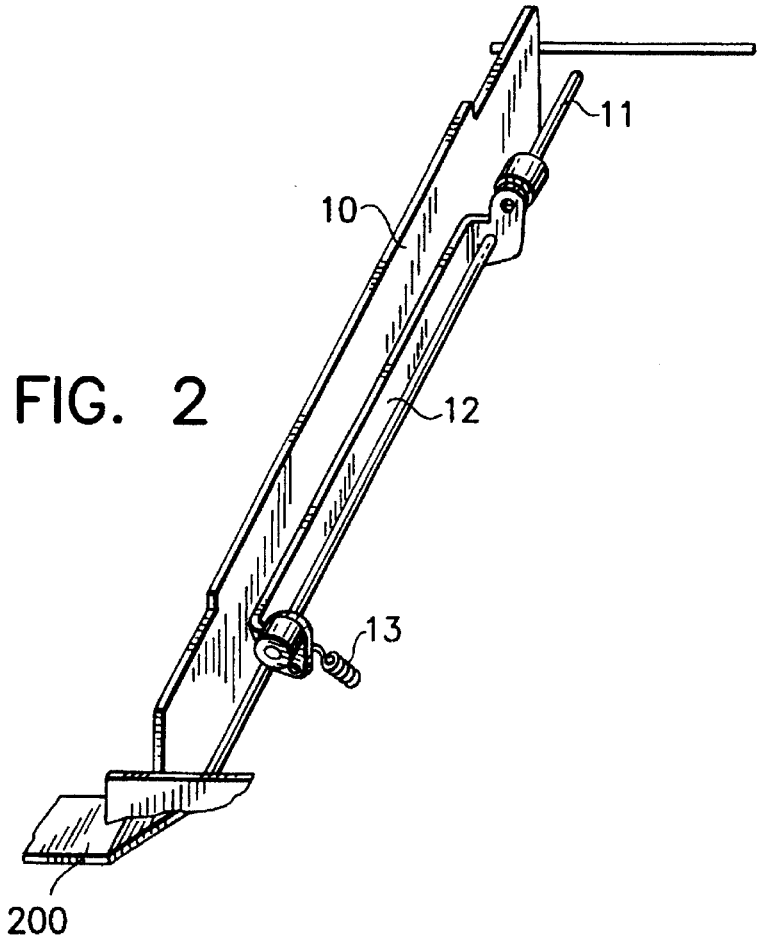
FIG. 2 is a fragmentary perspective view showing a shutter of such apparatus.

As shown in FIG. 2, a shutter 10 is provided at an inlet/outlet for a pay-out tray 200. Shutter 10 is secured to a support member 12 rotatably mounted on a shaft 11 provided in a casing. Support member 12 is biased by a coil spring 13 in a direction to close the inlet/outlet. When the pay-out tray projects, one end of the pay-out tray pushes shutter 10 open against the biasing force of coil spring 13.

When the pay-out tray is retracted, shutter 10 automatically closes the inlet/outlet with the force of coil spring 13. It is noted that it is difficult to open shutter 10 from the outside, and this has the effect of preventing foreign matter from being introduced through the inlet/outlet.

Figure 3:
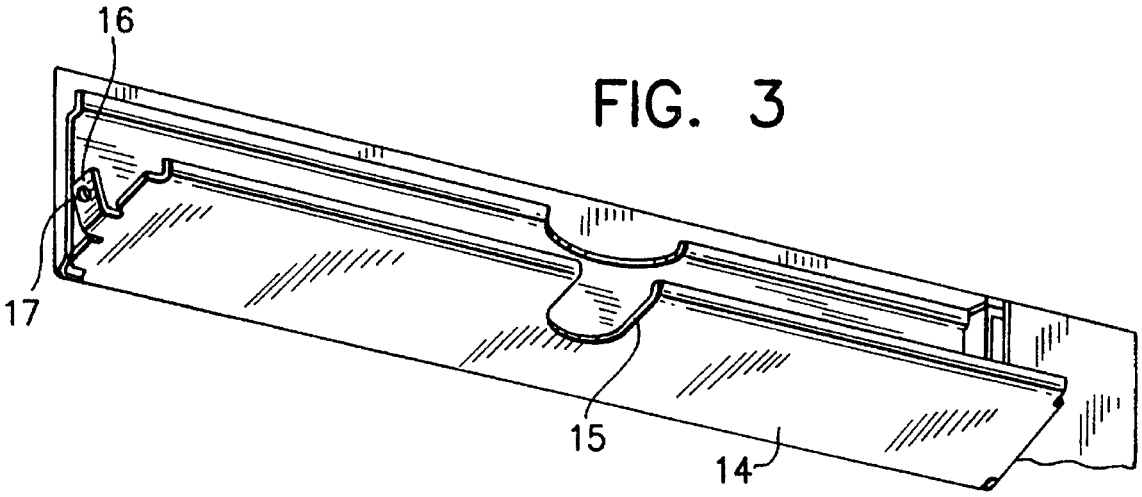
FIG. 3 is a fragmentary perspective view showing a lid of the stacking space.
Figure 4:
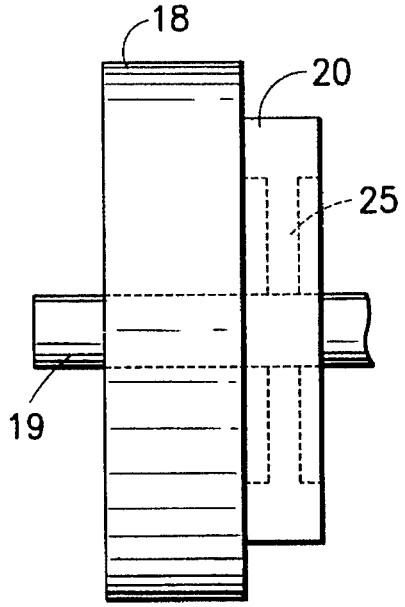
FIG. 4 is a front view showing a stationary roller mechanism of the apparatus.
Figure 5:
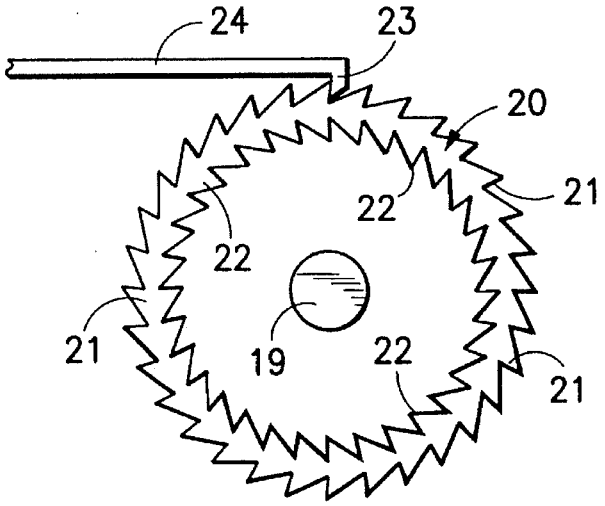
FIG. 5 is a side view showing a stepping gear of the apparatus.
Figure 6:
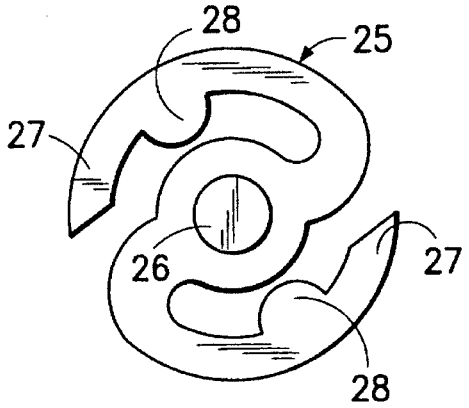
FIG. 6 is a side view showing an auxiliary member of the stepping gear.

Referring now to FIG. 3, there is shown a lid 14 mounted in a bank note stacking space. Lid 14 is pivoted at its lower edge, and has a substantial portion of the center of its upper edge formed with a finger application notch 15. The opposite ends of lid 4 each include an integral engagement portion 16 with an L-shaped sectional profile at a substantially central portion thereof. Each engagement portion 16 has a protuberance 17, with which the lid 14 is engaged with a casing. As a result of this arrangement of lid 14 in the bank note stacking space, such operations as the taking-out of bank notes and setting of bank notes therein for use as change, can be readily performed.

Referring now to FIGS. 4 to 7, there is shown a stationary roller mechanism including a stationary roller 18 supported on a shaft 19. Since stationary roller 18 is stationary, it serves to prevent bank notes from being fed in an overlapped state to the pay-out tray. However, if only a fixed circumference portion of stationary roller 18 was in contact with the bank notes, that fixed circumference portion would soon be worn out, making it difficult for the stationary roller mechanism to properly function. The stationary roller mechanism of the present invention has means for overcoming this drawback.

Specifically, a stepping gear or ratchet wheel 20 is mounted on shaft 19 such that stepping gear 20 is integral or in close contact with stationary roller 18. Stepping gear 20 is ring-like, and its outer and inner peripheries are formed with a plurality of latches or gear teeth 21 and 22, respectively, these gear teeth having predetermined angular orientations. Each outer peripheral gear tooth 21 can engage with an engagement pawl 23 at an end of a spring member 24.

A core member 25 is fitted in stepping gear 20 such that core member 25 is held therein by gear teeth 22. Core member 25 has a through hole 26 which is penetrated by shaft 9. Further, core member 25 has a pair of integral symmetrical arcuate portions 27 having a spring-like character, each arcuate portion having a free end. Each arcuate portion 27 also has a raised portion 28 formed on an inner side thereof as a sagging stopper.

Figure 7:
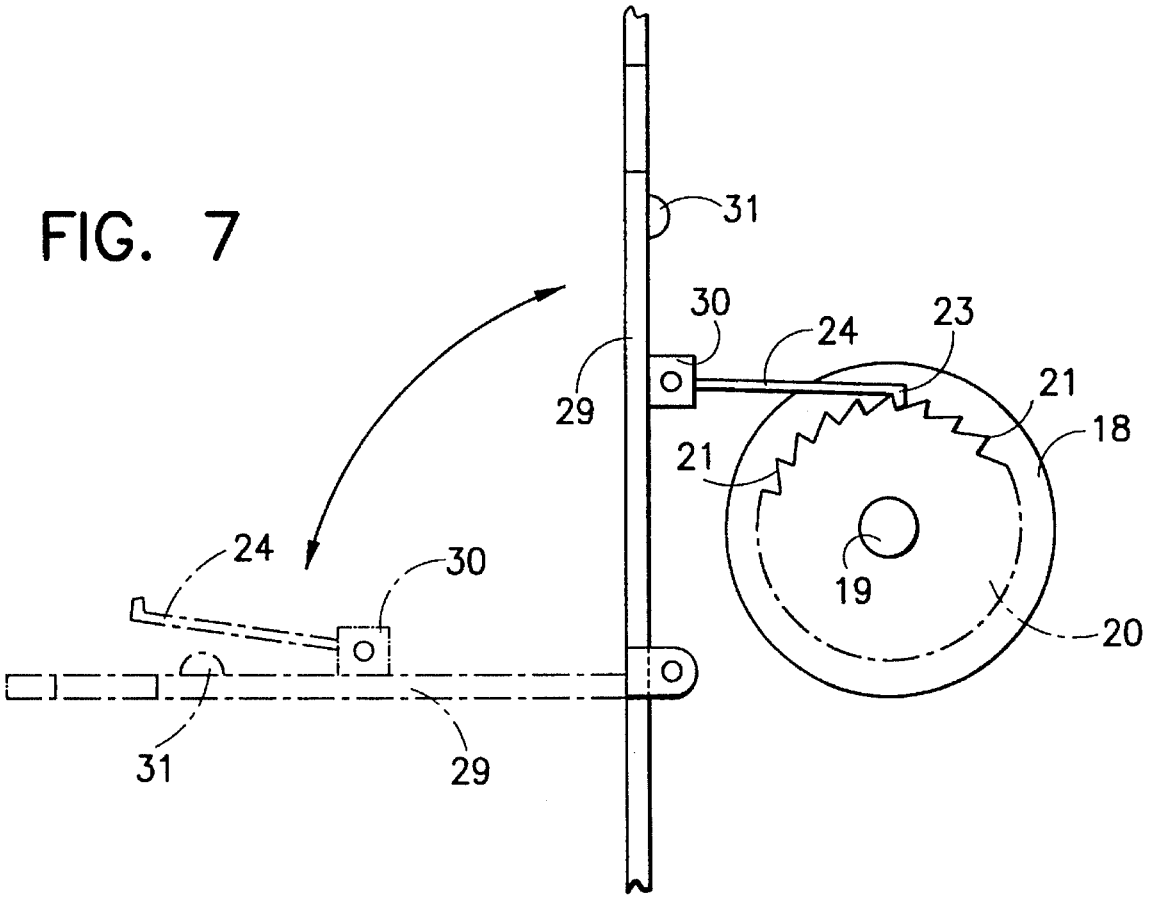
FIG. 7 is a side view showing an operating mechanism for a stationary roller mechanism of the apparatus.

As shown best in FIG. 7, spring member 24 is pivoted by a mounting member 30 connected to the surface of a lid 29 of a pay-out tray. By opening lid 29, as shown by the dot-dash lines, stepping gear 20 is rotated by one pitch of gear teeth 21 from its state in which one gear tooth 21 is in engagement with engagement pawl 23 of spring member 24, while at the same time the stationary roller 18 is correspondingly rotated therewith. Whenever stepping gear 20 is rotated, the contact surface of stationary roller 18 is shifted.

A stopper 31 is provided for preventing lid 29 from being struck by spring member 24 when lid 29 is opened, as shown by the dot-dash lines in FIG. 7. When lid 29 is thereafter closed, spring member 24 is brought into engagement with a gear tooth 21 of stepping gear 20 due to its own weight. In lieu of the structure shown in FIG. 7, it is possible to feed stepping gear 20, likewise urging a spring-biased bar or like member.

Figure 8:
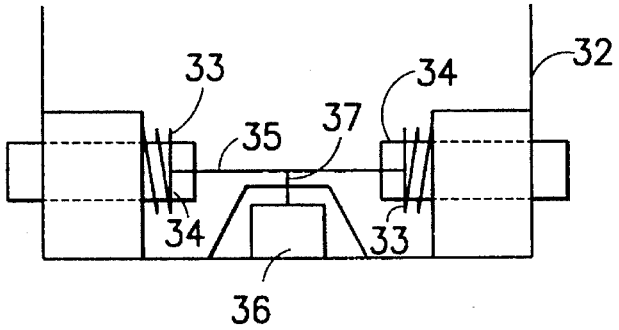
FIG. 8 is a plan view showing the lid before being operated.
Figure 9:
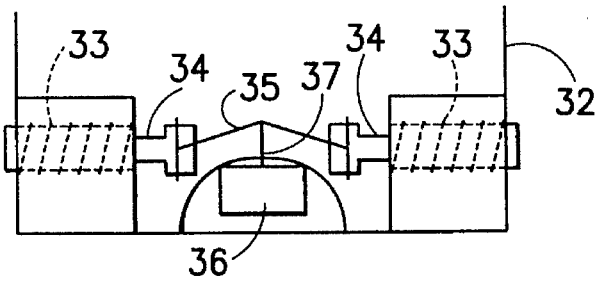
FIG. 9 is a plan view showing the lid after being operated.

Referring now to FIGS. 8 to 11, there are shown various embodiments of the mechanism for locking and unlocking lid 14 or lid 29. In the first place, the embodiment shown in FIGS. 8 and 9 is of a push type. In this embodiment, lock pins 34, which are spring-biased by springs 33, are mounted in side walls of a casing 32, and are connected together by a leaf spring 35. Leaf spring 35, which is adapted to be bent as its center, is pushed by an end of a pin 37 mounted in a push button 36. By the force that is produced as a result of pin 37 acting on leaf spring 35, lock pins 34 are pulled inwardly to effect an unlocking operation, thereby freeing the lid to be opened. During a closing operation, the lid is returned to its closed position, whereby the locking arrangement by lock pins 34 is automatically effected by the forces of coil springs 33 and leaf spring 35. In other words, lock pins 34 are forced outwardly to effect a locking operation.

Figure 10:
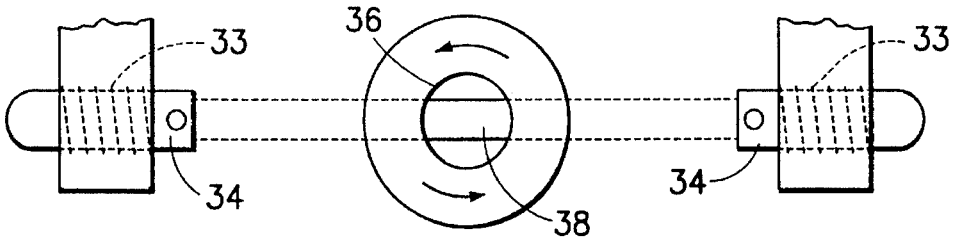
FIG. 10 is a plan view showing a different operating mechanism for the lid.
Figure 11:
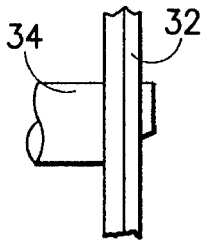
FIG. 11 is an end plan view of the operating mechanism of FIG. 10.

In the embodiment of FIG. 10, a rotary knob 38 is added in addition to the above push type structure, thus permitting a locking and unlocking operation to be effected by selective rotation.

Referring now to FIGS. 12 to 16, there are shown mechanisms for conveying and accommodating bank notes, which permit a further size reduction of the apparatus and a simplification of the mechanisms.

Figure 12:
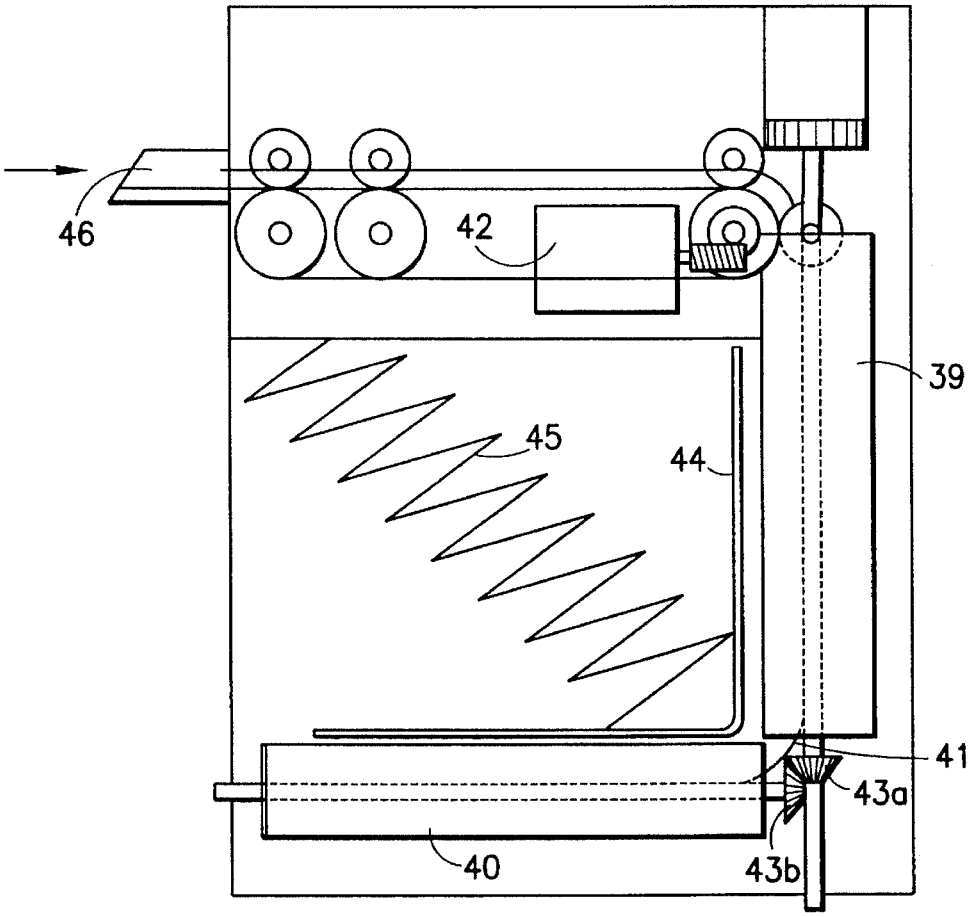
FIG. 12 is a side view showing a bank note accommodating mechanism of the apparatus.
Figure 13:
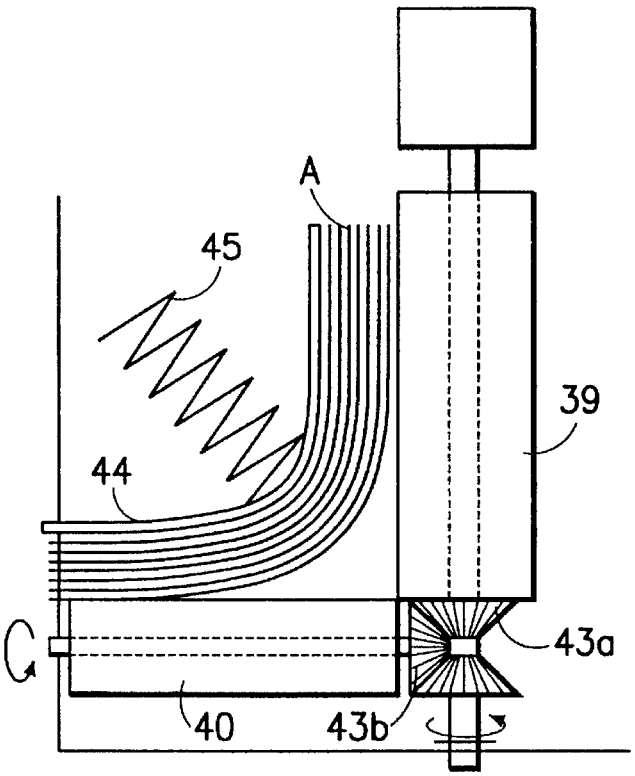
FIG. 13 is a side view showing the bank note accommodating mechanism of FIG. 12.

First, the mechanism shown in FIGS. 12 and 13 will be described. In this mechanism, a pair of first guide bars 39 and a pair of second guide bars 40 are disposed such that they are perpendicular to each other. Guide bars 39 and 40 each have a length substantially corresponding to one-half of the length of the bank note to be conveyed, and each also has an S-shaped sectional profile. Each guide bar 39 and a corresponding guide bar 40 are connected to each other by an arcuate guide 41.

A drive motor 42 is provided for rotating guide bars 39. Guide bars 39 are adapted to be rotated by a one-half rotation via a gear mechanism, thus causing an interlocked operation of guide bars 40 which are coupled by bevel gears 43*a* and 43*b* to guide gars 39. A substantially L-shaped bank note retainer 44 is provided, which is spring-biased by a spring 45 toward guide bars 39 and 40.

Thus, a bank note, having been inserted from an insertion opening 46 and determined to be a genuine bank note, is loaded by a roller, a belt or the like in the apparatus, and is then bent along a guide, to be tentatively held by guide bars 39 and 40. When this state is detected by a sensor, guide bars 39 and 40 are caused to undergo a one-half rotation to urge the bank note A against retainer 44, as shown in FIG. 12. As this sequence of operations is repeatedly performed, bank notes A are stacked in a half folded state. It is thus possible to provide an apparatus, the depth of which is smaller than the length of the bank note.

Figure 16:
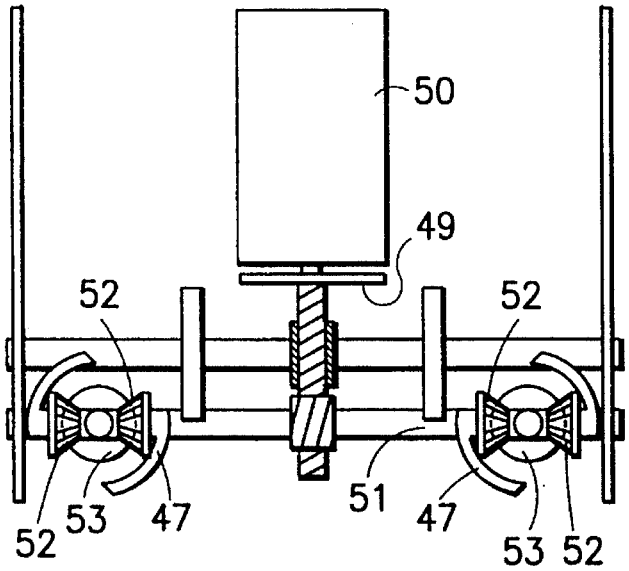
FIG. 16 is a rear view of the sorting/accommodating mechanism of FIG. 14.
Figure 14:
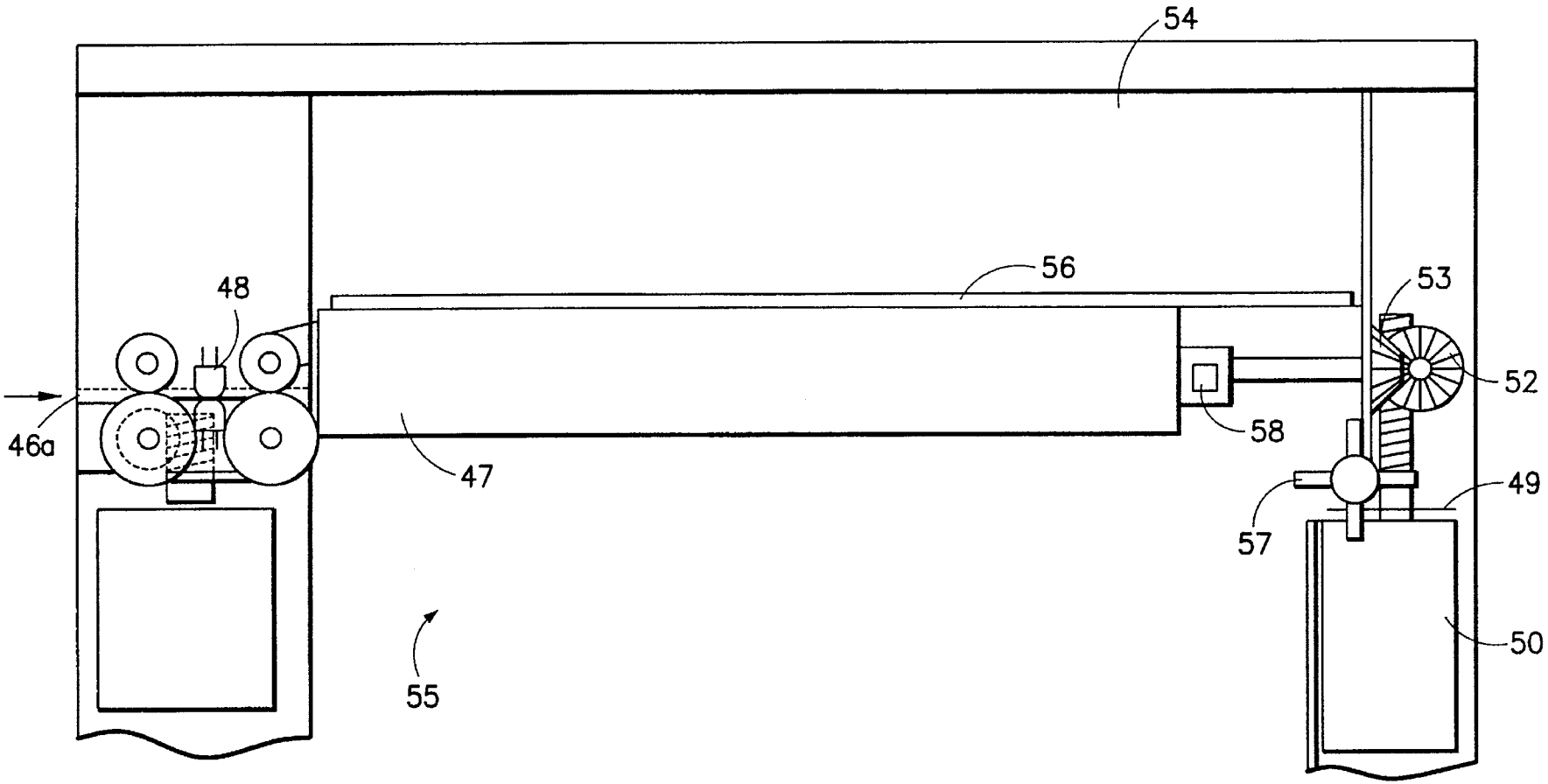
FIG. 14 is a side view showing a bank note sorting/accommodating mechanism of the apparatus.
Figure 15:
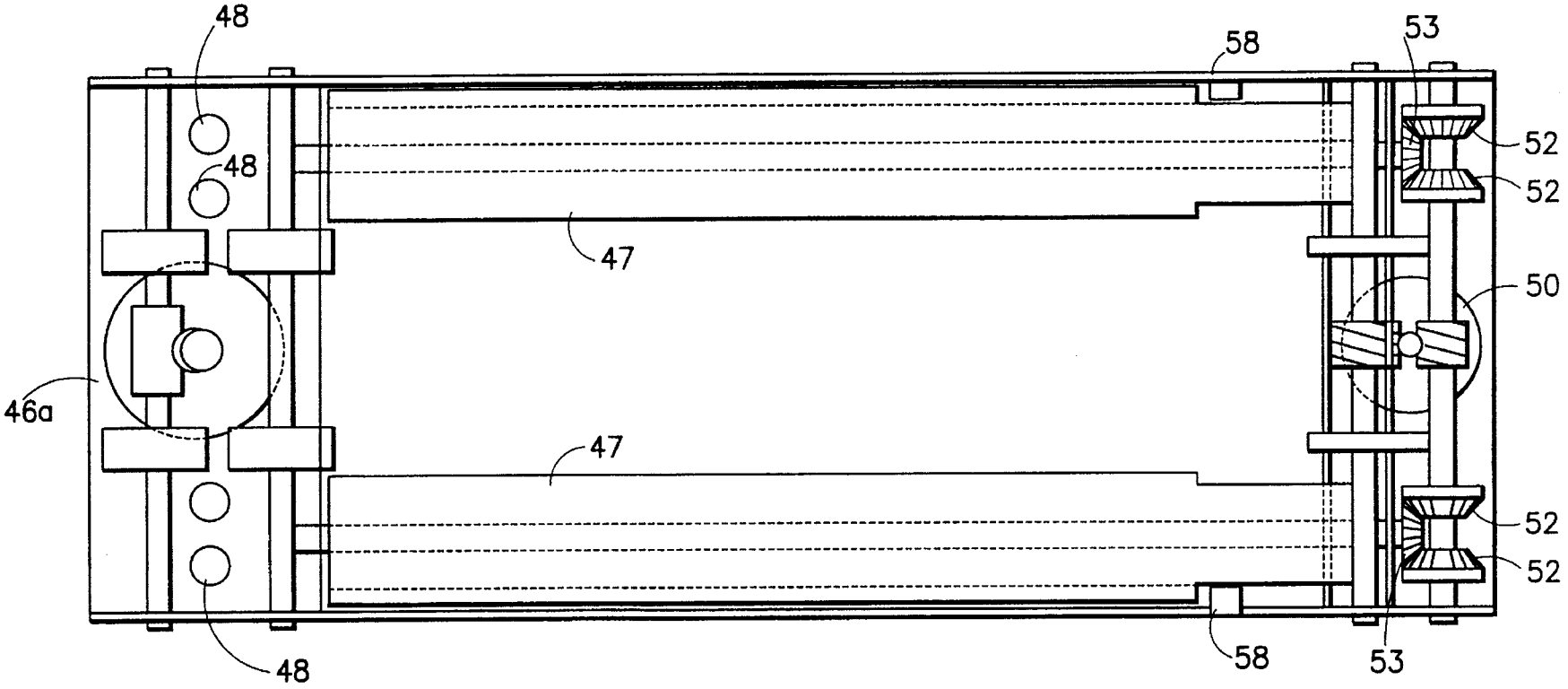
FIG. 15 is a plan view of the sorting/accommodating mechanism of FIG. 14.

Referring now to FIGS. 14 to 16, there is shown a bank note sorting/accommodating mechanism, which permits a size reduction of the apparatus and a simplification of the mechanisms. Recently, apparatus has been developed which can handle bank notes of a large monetary value, as well as smaller bank notes, such as 1,000 yen bank notes. In such apparatus, the large monetary value bank notes and the 1,000 yen bank notes are sorted and accommodated so as to permit recycled use of the 1,000 yen bank notes as change. In the prior art, however, the mechanisms for feeding bank notes to the individual stacking spaces are complicated.

The bank note sorting/accommodating mechanism according to the present invention permits very simple and accurate sorting and accommodation. Specifically, this mechanism comprises a pair of guide bars 47 which have substantially the same length as a bank note and which have an S-shaped sectional profile. Guide bars 47 have a tapered or R-shaped free edge. A bank note having been inserted from an insertion opening 46a is checked as to its genuineness and kind by optical sensors 48, and then loaded by conveying means such as rollers or a belt in the apparatus to a position in which its opposite edges are held by guide bars 47.

When it is confirmed that the bank note is held by guide bars 47, a shaft 51, which is gear coupled to the shaft of a motor 50, is rotated. Shaft 51 has bevel gears 52 provided adjacent its opposite ends, with bevel gears 52 being in mesh with bevel gears 53 provided at an end of the shafts of guide bars 47 for rotating guide bars 47. It will be appreciated that it is possible to replace the bevel gears with spur gears or the like. A stacking space 54 for large monetary bank notes is provided above guide bars 47, and a 1,000 yen bank note stacking space is provided therebelow. An urging member 56 is provided in association with stacking space 54, and a cross vane wheel 57 is provided in association with stacking space 55 to allow 1,000 yen bank notes to fall in a nearly aligned state.

Bank note winding prevention members 58 are formed by rising portions of the casing.

Motor 50 is controlled such-that reverse rotation of guide bars 47 is caused depending on the kind of the inserted bank note. Thus, 1,000 yen and large monetary amount bank notes can be fed to the respective stacking spaces 54 and 55 without any specific conveying path. From stacking space 55, 1,000 yen bank notes are fed progressively as change to the lower pay-out tray. Since guide bars 47 have tapered or R-shaped free ends, smooth frictional contact can be obtained when bank notes are fed to the individual stacking spaces 54 and 55 by an operation involving reverse rotation of guide bars 47.

Figure 17:
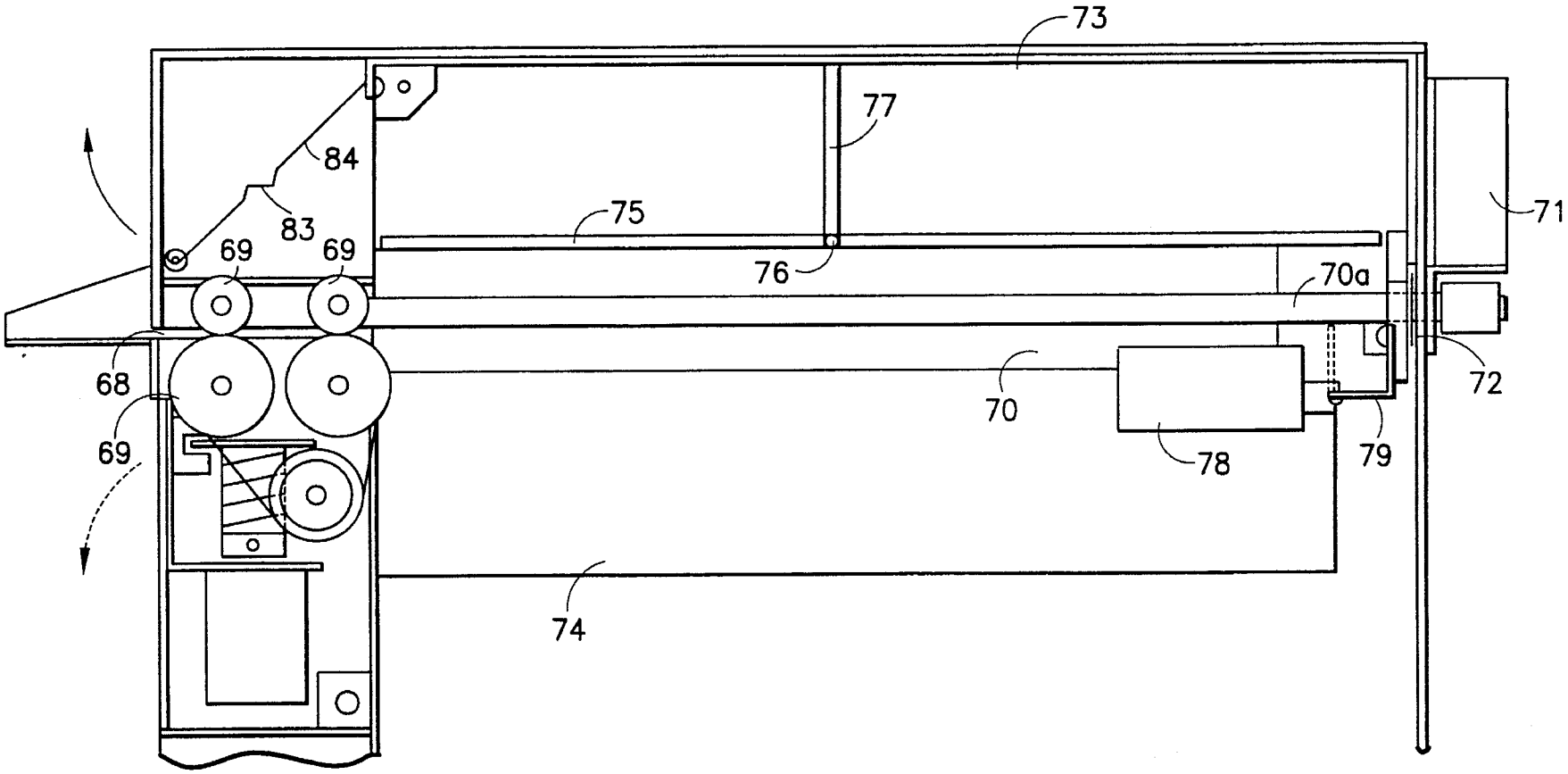
FIG. 17 is a side view showing a conveying path and stacking spaces of the apparatus.

Referring now to FIG. 17, there is shown a sorting/accommodating mechanism. Specifically, a loading mechanism including rollers 69 is disposed subsequent to or after a bank note insertion opening 68. Subsequent to the loading mechanism, there is disposed a pair of rotary guide bars 70 having a substantially S-shaped sectional profile and having grooves for guiding the opposite edges of bank notes. The pair of rotary guide bars 70 are rotatable forward and backward by 180 degrees, and position control thereof is performed by encoders 72 mounted on the shaft 70*a* of rotary guide bars 70.

A large monetary amount bank note stacking space 73 is provided above rotary guide bars 70, and a 1,000 yen bank note stacking space 74 is provided below rotary guide bars 70. When an inserted bank note is determined to be a genuine bank note, the direction of rotation of rotary guide bars 70 is determined to feed the bank note to either stacking space 73 or stacking space 74. In the large monetary amount bank note stacking space 73, a bank note urging member 75 is provided. Urging member 75 has guide pins 76 projecting from its edges and engaging in vertical slits 77 formed in the side walls of stacking space 73. Thus, it is movable upward to urge the stack of bank notes from below.

An aligning member 79 which is movable forward by a solenoid 78, is provided at the rear of rotary guide bars 70. Since the 1,000 yen bank note has a small length compared to larger monetary amount bank notes, aligning member 79 serves to re-engage the 1,000 yen bank note in the grooves of rotary guide bars 70 to an accurate position, so as to increase the accuracy of falling of the 1,000 yen bank note into stacking space 74 for accommodation therein.

Figure 18A:
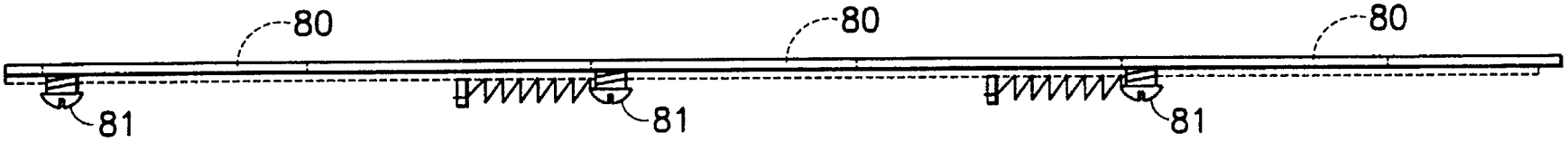
FIGS. 18A and 18B are top and side view, respectively, showing a movable part of the apparatus.
Figure 18B:
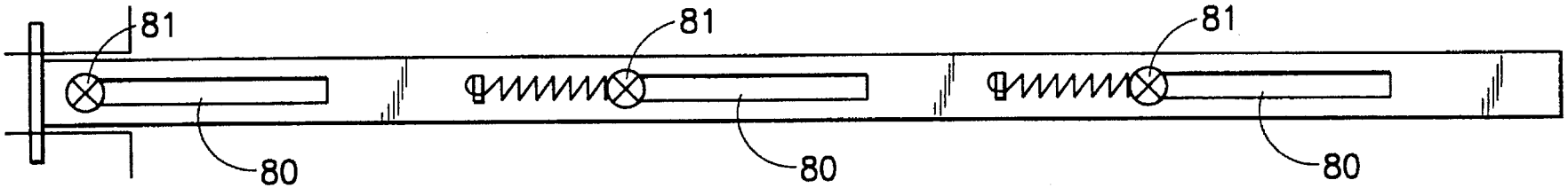

As shown in FIGS. 18A and 18B, large monetary amount bank note stacking space 73 has its side walls and ceiling provided with guide grooves 80 into which extend screws 81 for controlling the sliding direction of the side walls and ceiling. Large monetary amount bank note stacking space 73 can be guided by screws 81 and drawn forward by several centimeters from its assembled state with a front finger hook 82.

As shown in FIG. 17, a front top portion of large monetary amount bank note stacking space 73 and a top portion of bank note insertion opening 68 are tied to each other by a wire member 84 having an intermediate spring portion 83. When the large monetary amount bank note stacking space 73 is withdrawn up to a fixed position, the dead point of spring 83 is passed, and stacking space 73 escapes along grooves 80 and is opened upward automatically. In this way, the operation of taking out large monetary amount bank notes can be facilitated.

Figure 19:
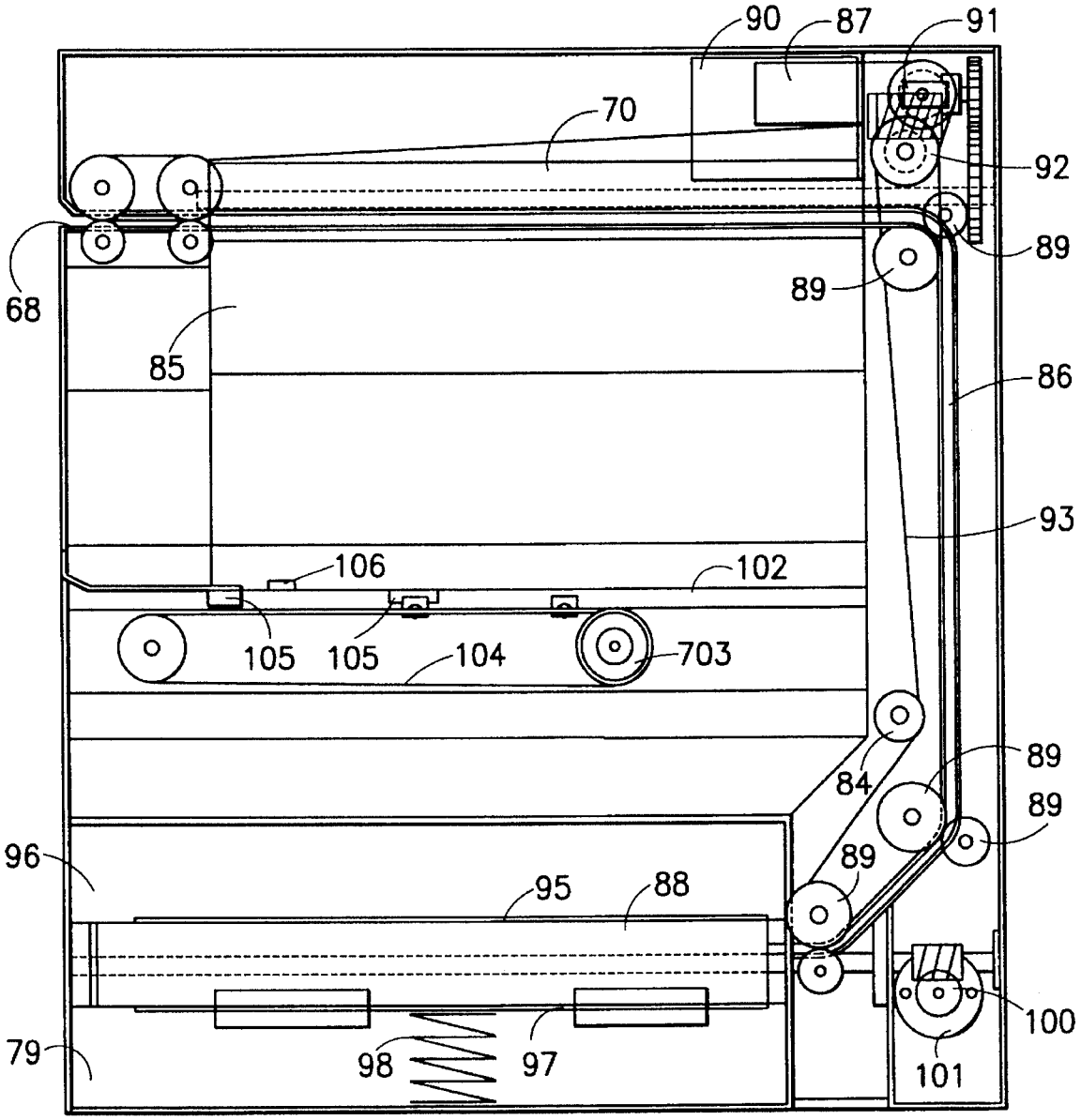
FIG. 19 is a side view showing a three kind bank note sorting/accommodating mechanism of the apparatus.

FIG. 19 shows a bank note sorting/accommodating mechanism, which does not only sort between the 1,000 yen and larger monetary amount bank notes, but also sorts out the different kinds of the large monetary amount bank notes. Nevertheless, it can be installed in a space with a width of 100 mm, a height of 300 mm and a depth of 250 mm. In this mechanism, a pair of rotary guide bars 70 having a substantially S-shaped sectional profile extend from bank note insertion opening 68 to a loading mechanism. When a recycled bank note is inserted in the grooves of rotary guide bars 70, it is stopped in these grooves to be allowed to fall into and be accommodated in a lower recycled bank note stacking space/hopper 85 where it can be used for change. In the case of a large monetary amount bank note, such bank note is fed to a conveying path 86 extending from the grooves of rotary guide bars 70. The conveying of the large monetary value bank note along conveying path 86 is accomplished by the driving of a solenoid 87 in response to an input from a money amount sensor.

Conveying path 86 communicates with grooves formed in a pair of second rotary guide bars 88 having a substantially S-shaped sectional profile. As means for conveying a large monetary amount bank note up to second rotary guide bars 88, pulleys 89 are used. A belt 93 is passed around pulleys 89, and is also passed around a roller 92, which in turn, is coupled via a clutch mechanism 94 to a drive motor 90 for driving a loading mechanism extending from bank note insertion opening 68. Tension is applied to a portion of belt 93 by a roller 94.

A first large monetary amount bank note stacking space 96 with a free urging member 95 is provided above second rotary guide bars 88, and a second large monetary amount bank note stacking space 99 with an urging member 97, which is spring biased by a coil spring 98, is provided below guide bars 88. The rotation of rotary guide bars 88 for sortingly accommodating bank notes in individual stacking spaces 96 and 99 is caused by an exclusive motor 101 via a worm gear mechanism 100.

Recycled bank notes that have been accommodated in recycled bank note stacking space/hopper 85, are fed in a necessary quantity to a pay-out tray 102 by a roller friction mechanism. When a recycled bank note is fed to pay-out tray 102, there is the possibility that it will strike a wall of pay-out tray 102 which may cause problems in the pay-out. Therefore, a mechanism for aligning the bonded bank notes is necessary. However, such a special mechanism may be dispensed with by stretching a non-repulsive rubber member over the wall surface, as will be described later. Pay-out tray 102 can be moved back and forth by a belt 104 driven by a motor 103. In this embodiment, two photo-interrupters 105 are provided to confirm the position of pay-out tray 102. Further, a sensor 106 for checking whether a bank note used as change has been withdrawn, is provided to ensure a more reliable operation. The front of recycled bank note stacking space 85 and the case portion therewith are tiltable forward for replenishing space 85 with recycled bank notes.

Figure 20:
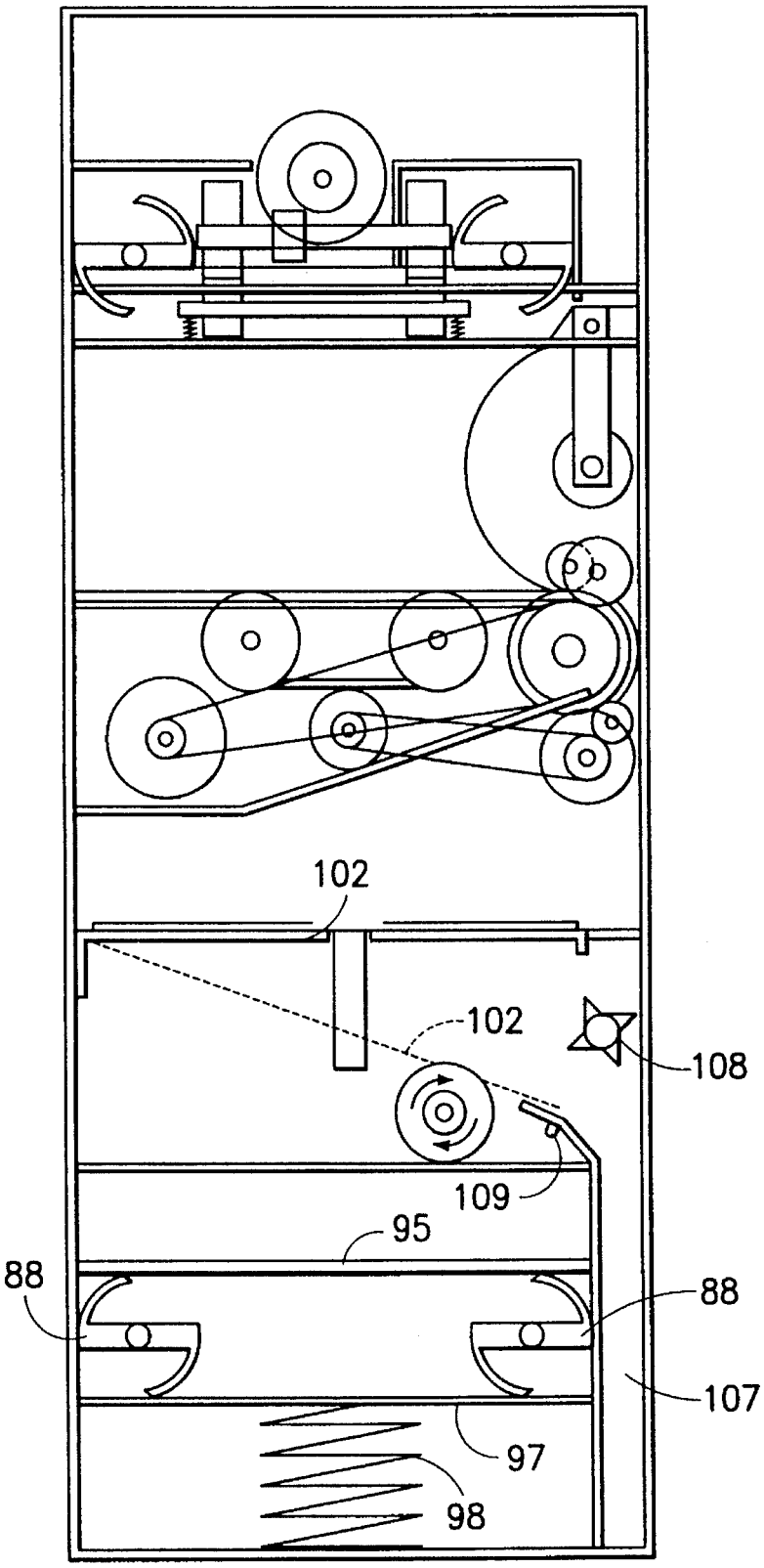
FIG. 20 is a front view showing an apparatus provided with a miscount bank note accommodating mechanism.

Referring now to FIG. 20, there is shown a processing mechanism which is operated upon occurrence of a miscount of recycled bank notes fed to pay-out tray 102. Upon the occurrence of such a miscount, one edge of pay-out tray 102 is tilted with the driving of a motor or a solenoid, and the bank notes are fed into a pocket 107 formed adjacent second rotary guide bars 88 and stacking spaces 96 and 99, by means of the feeding rotation of pulleys and the disposing rotation of a cross vane wheel 108. When this operation is confirmed by a confirmation sensor 109, pay-out tray 102 is restored to the normal position and the counting of bank notes is resumed.

Figure 21:
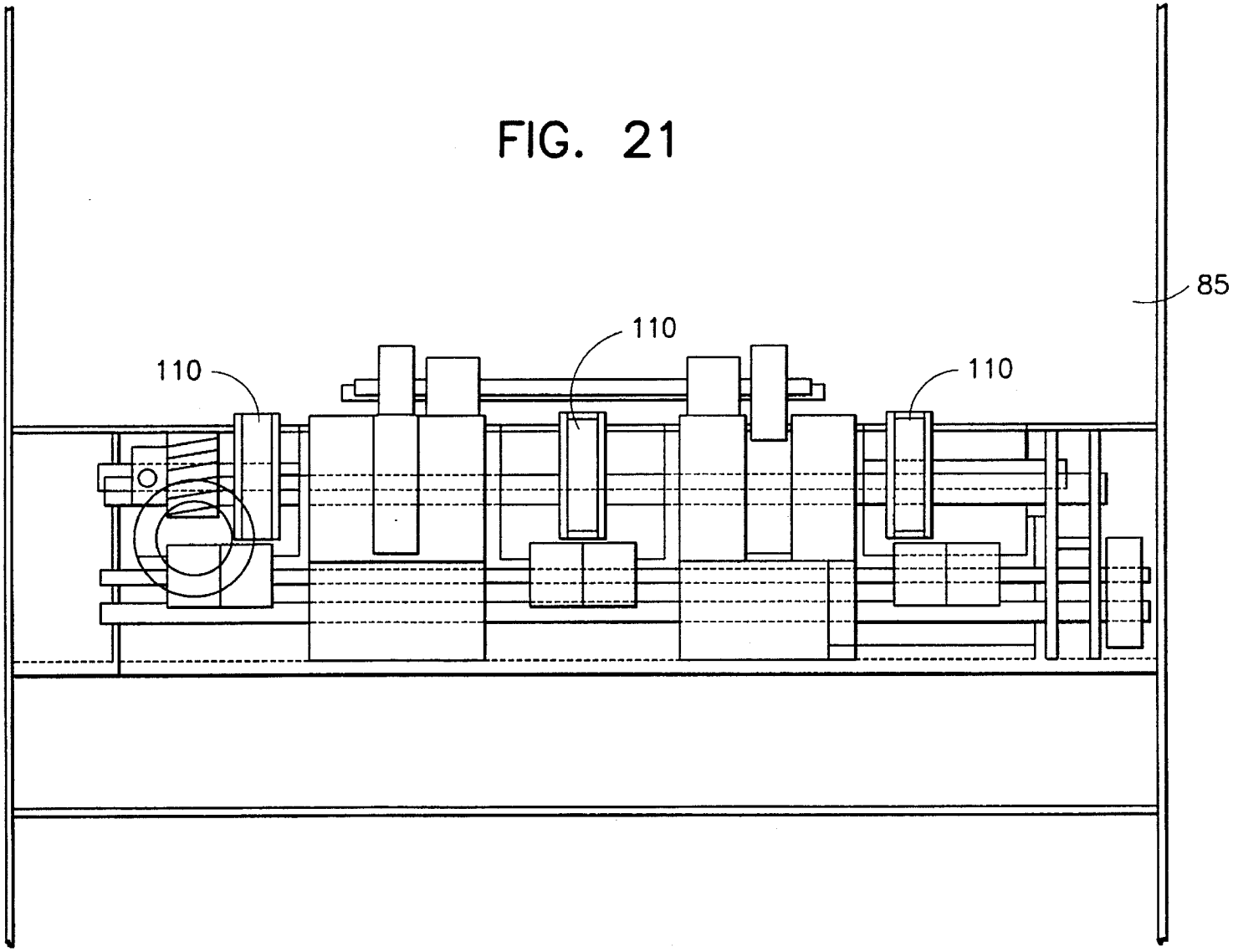
FIG. 21 is a side view showing a feeding mechanism for feeding to a recycled bank note pay-out tray.
Figure 22:
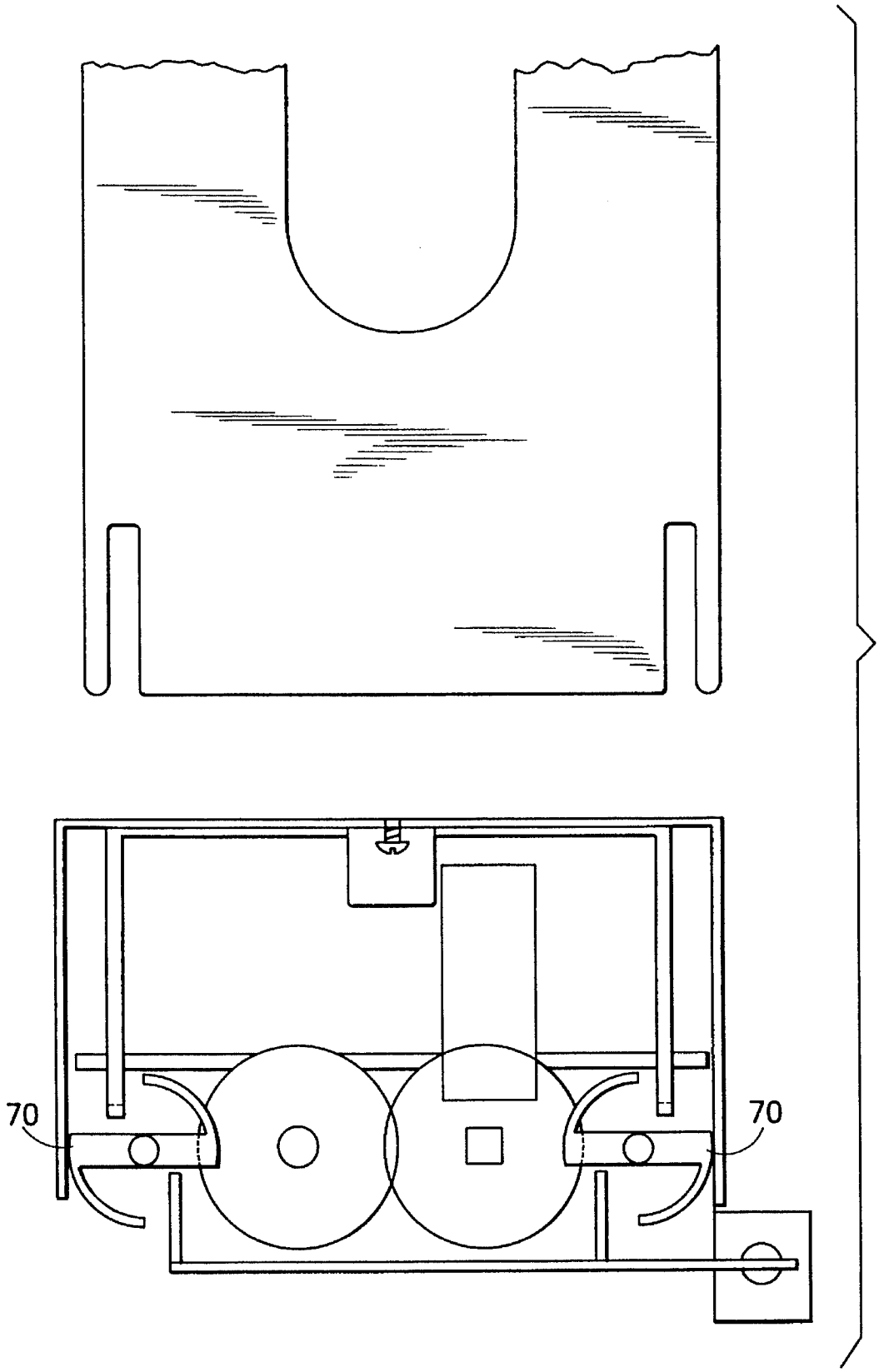
FIG. 22 is a front view showing a large monetary amount bank note take-out mechanism of the apparatus.
Figure 23:
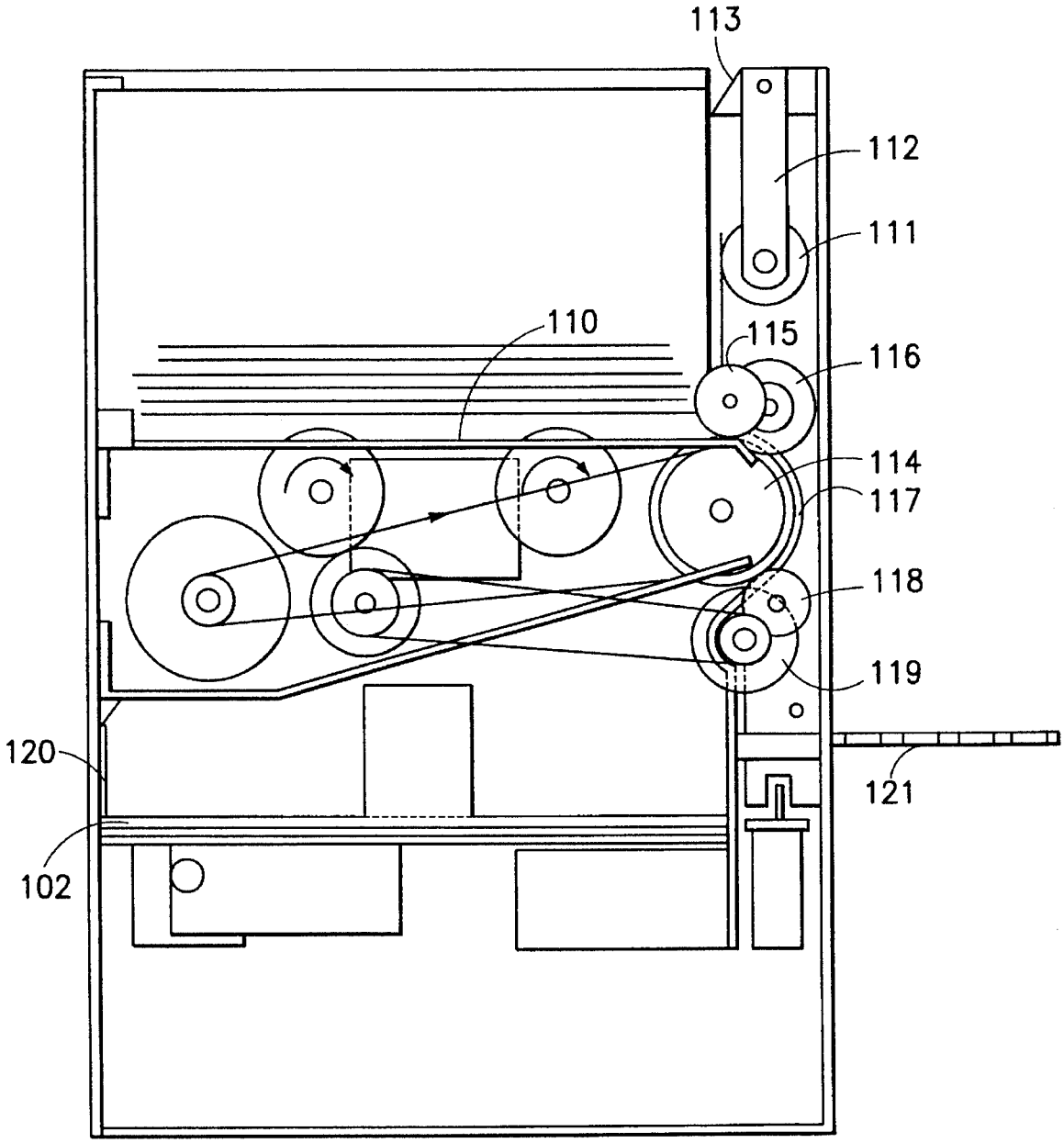
FIG. 23 is a front view showing a roller friction mechanism of the apparatus.

In this embodiment, recycled bank note stacking space/hopper 85 has a horizontal bottom, and initial conveying of a bank note is performed by three belts 110 passed around pulleys, as shown in FIG. 21, in lieu of conventional eccentric rollers, to feed the bank note to the roller friction mechanism. Further, a channel-shaped swing arm 112 which is driven by a motor 111, is mounted in recycled bank note stacking space/hopper 85, as shown best in FIG. 23. A pivotal urging member 113 is provided between free ends of channel-shaped swing arm 112 for suppressing wrinkles and folding-traces of accommodated recycled bank notes, to obtain a neat stack of bank notes.

The roller friction mechanism noted above includes a urethane main roller 114 having a diameter of about 20 mm, which is much smaller compared to that of the prior art. A pinch roller 115 and an overlap feed prevention stationary roller 116 are provided prior to the winding of a recycled bank note on main roller 114. Stationary roller 116 is rotatable only in the direction of feeding of a recycled bank note, in order to cope with wear, and has a hardness ranging from 40 to 60. An arcuate guide 117 is provided along main roller 114, and also a feed roller 118 for feeding a bank note to pay-out tray 102 and a suppressing roller 119, mostly in the form of a vane wheel, for suppressing the flying and popping of recycled bank notes are provided. As noted above, a non-repulsive rubber member 120 is stretched over one wall surface of pay-out tray 102. One side of a portion of the case extending from stacking space/hopper 85 to pay-out tray 102 can be opened and closed when accommodating recycled bank notes for change, while the other side has a door 121 which can be opened when removing jams.

As shown in FIG. 24, rotary guide bars 70 and 88 noted above, having the substantially S-shaped sectional profile, are provided with bank note winding inhibiting spring members 122 made of an elastic material such as a plastic material. Spring members 122 have a length such that their ends slightly enter the grooves in a stand-by state, in which case, rotary guide bars 70 and 88 are ready to receive a bank note. Specifically, spring members 122 have the function of flicking a bank note when the bank note is going to be wound. Each winding inhibiting spring member 122 is provided with a plurality of nodes or streaks 123 for distributing the offered resistance.

Between the pair of rotary guide bars 70 or 88, there is provided a mechanism for raising a bank note, and specifically, which assists the raising of a bank note if the opposite edges thereof fail to enter the grooves accurately due to a V-shaped folding trace in the bank note.

As shown in FIGS. 25 and 26, withdrawal prevention members 59 and 60 are mainly disposed between rotary guide bars 70 and 88. Withdrawal prevention member 59 is secured to the rear end of a mounting member 61 for mounting various sensors therein. Withdrawal prevention member 59 has two outer pawls 62 inclined slightly downward and a central pawl 63 directed upward. Withdrawal prevention member 60 has a crankshaft-like shape, and has one end secured by a screw 64 or the like. A thread or a thin tape is tied to the bank note, so that the bank note can not be withdrawn but is caught when it is intended to withdraw the bank note when a purchase of a product or an exchange is ended. When the bank note is conveyed, its central line is first raised by central upwardly directed pawl 63 of withdrawal prevention member 59 and is then lowered by withdrawal prevention member 60.

As shown in FIG. 27, a swing door 65 is pivotally supported in front of bank note insertion opening 68. Swing door 65 has a lower end extending slightly below insertion opening 68, and is adapted to open the path thereto along an arcuate notch 66. The top of swing door 65 is provided with a photo-interrupter 67 for use for starting the mechanism. With this mechanism, swing door 65 normally makes it impossible to recognize the position of the inner sensor group. If foreign matter is caught between the lower edge of swing door 65 and the top of notch 66 so that photo-interrupter 67 can not be restored, and is held in this state for a predetermined period of time, an unloading operation of the mechanism is caused.

As shown in FIG. 28, a thin base member 124 is provided, which is made of a flexible material such as a metal or plastic, and in the case of a plastic material, is coated with a paint to ensure blocking of light. Thin base member 124 has a substantially central portion which is bent at right angles, thus providing a central ridge 125.

Further, thin base member 124 is symmetrically bent at right angles at two positions, thus forming end portions 126 and 127. An ultraviolet radiation emitting element 128 is secured to end portion 126, with its emitting or lens section 129 on the inside, that is, on the side of ridge 125. A light-receiving element 130 is secured to the other end portion 127, with its light-receiving section 131, that is, its converging lens section, on the inside, that is, on the side of the ridge 125.

A shield box 134 is fit on thin base member 124, on which light-emitting and light-receiving elements 128 and 130 are mounted, to prevent sidewise leakage of ultraviolet rays.

When assembling the photo-electric element of ultraviolet radiation having the above construction in a bank note genuineness checking unit, a light-emitting paint 133 is spot printed on a portion of a bank note conveying path 132, and light-emitting element 128 is set at a position, at which the focal point of light beam L projected from light-emitting element 128 coincides with spot 133 of the paint. When light-emitting element 128 is assembled at this position, a reflected beam P, which contains a reaction signal based on a special ink, is coupled to a light-receiving section 131 of light-receiving element 130.

With this structure, while a bank note inserted from the bank note insertion opening of the apparatus is loaded along the conveying path, if it is a genuine bank note, a signal indicative of a reaction is obtained, and thus an electric confirmation signal is output. In this way, the genuineness check is effected.

Further, for automatic focusing with respect to light-emitting paint 133, a distance sensor with respect to conveying path 132 may be mounted on a portion of ridge 125 of thin base member 124, and thin base member 124 may be made movable by a drive source such as a motor or a solenoid.

Having described specific preferred embodiments of the invention with reference to the accompanying drawings, it will be appreciated that the present invention is not limited to those specific embodiments, and that various changes and modifications can be effected therein by one of ordinary skill in the art, and the various features can be used in any combination, without departing from the scope or spirit of the invention as defined in the appended claims.

What is claimed is:

1. An apparatus for conveying, accommodating and paying out bank notes, comprising:

large monetary amount bank note stacking space means for holding large monetary amount bank notes, recycled bank note stacking space means for holding recycled bank notes used as change, a pair of rotatable bank note guide bars disposed in a conveying path and communicating with a bank note insertion opening, said bank note guide bars being positioned below said large monetary amount bank note stacking space means and above said recycled bank note stacking space means, such that said bank notes are deposited in and supported by said bank note guide supplied from said bank insertion opening, said bank note guide bars always being in a preset initial rotational receiving position when said bank notes are deposited thereon from said bank insertion opening, and means for bi-directionally rotating said bank note guide bars from said initial rotational receiving position such that rotation of said bank note guide bars in a first direction causes said guide bars to feed the bank notes thereon to said large monetary amount bank note stacking space means and rotation of said bank note guide bars in a second opposite direction causes said guide bars to feed the bank notes thereon to said recycled bank note stacking space means.

2. In an apparatus according to claim 1, further including urging means for urging large monetary amount bank notes in said large monetary amount bank note stacking space means above said guide bars.

3. In an apparatus according to claim 1, further comprising:

shafts on which said guide bars are mounted; and bank note winding prevention means extending from a casing to said shafts of said guide bars.

4. In an apparatus according to claim 1, further comprising sensor means, including an integral group of sensors, for checking genuineness of bank notes and determining a kind thereof, said sensor means being mountable and dismountable from said apparatus.

5. In an apparatus according to claim 1, wherein each said bank note guide bar has an S-shaped sectional profile.

6. A apparatus for conveying, accommodating and paying out bank notes, comprising:

large monetary amount bank note stacking space means for holding large monetary amount bank notes, recycled bank note stacking space means for holding recycled bank notes used as change, a pair of rotatable bank note guide bars disposed in a conveying path and communicating with a bank note insertion opening, said bank note guide bars being positioned below said large monetary amount bank note stacking space means and above said recycled bank note stacking space means such that bank notes are selectively fed by said guide bars to either of said bank note stacking space means upon forward or reverse rotation of said guide bars, respectively, said guide bars having grooves therein, and aligning means for adjusting for a small length bank note to re-engage the small length bank note in the grooves of said guide bars so as to increase the accuracy of falling of the small length bank note into said recycled bank note stacking space means.

7. In an apparatus for conveying, accommodating and paying out bank notes, the improvement comprising:

a pair of first rotary guide bars extending from a bank note insertion opening, and for each having an S-shaped sectional profile for guiding opposite edges of the bank notes;

a recycled bank note stacking space/hopper means, provided below said first rotary guide bars, for holding recycled bank notes;

large monetary amount bank note conveying path means, having one end extending from an end of said first rotary guide bars opposite said insertion opening, for conveying large monetary amount bank notes from said first rotary guide bars, a pair of second rotary guide bars extending from an opposite end of said large monetary amount bank note conveying path means so as to receive large monetary amount bank notes from said large monetary amount bank note conveying path means, and large monetary amount bank note stacking space means provided above and below said second rotary guide bars.

8. In an apparatus according to claim 7, wherein said second rotary guide bars have an S-shaped sectional profile and each of said first and second rotary guide bars has a groove, and further comprising bank note winding inhibiting spring means disposed near each of said first and second rotary guide bars and having a length such that an end thereof slightly extends in a groove in a respective said rotary guide bar in a stand-by state thereof in which a bank note is inserted.

9. In an apparatus according to claim 8, wherein said spring means is made of a plastic material and is provided with node means for distributing a resistance force thereacross.

10. An apparatus according to claim 7, further comprising friction roller means and a plurality of belt means positioned between said stacking space/hopper means and a pay-out tray for conveying recycled bank notes from said stacking space/hopper means to the pay-out tray.

11. In an apparatus according to claim 10, further comprising overlap feed prevention stationary roller means in contact with said friction roller means for feeding bank notes from said recycled bank note stacking space/hopper means to said pay-out tray, said overlap feed prevention stationary roller means being rotatable in one direction only and having a hardness ranging from 40 to 60.

12. An apparatus according to claim 10, further comprising a pay-out tray having a non-repulsive rubber member provided on a side of the pay-out tray in contact with a recycled bank note.

13. In an apparatus according to claim 7, wherein said stacking space/hopper means includes swing arm means for applying pressure to the bank notes and removing wrinkles and folding traces of the bank notes.

* * * * *